United States Patent [19]

Cousins

[11] Patent Number: 5,036,591

[45] Date of Patent: Aug. 6, 1991

[54] UTILITY KNIFE

[76] Inventor: Morison Cousins, 229 E. 28th St., New York, N.Y. 10016

[21] Appl. No.: 565,277

[22] Filed: Aug. 9, 1990

[51] Int. Cl.[5] ..... B26B 1/00; B26B 1/04; B26B 1/08

[52] U.S. Cl. ..... 30/335; 29/453; 30/330; 30/331; 76/104.1

[58] Field of Search ..... 30/330, 331, 332, 334, 30/335, 337, 339, 346; 29/453; 76/104.1

[56] References Cited

U.S. PATENT DOCUMENTS

| | | | |
|---|---|---|---|
| 1,796,870 | 3/1931 | Huhn et al. | 30/331 |
| 2,104,276 | 1/1938 | Schmidt | 30/331 |
| 2,478,668 | 8/1949 | Shepard et al. | 30/330 |
| 4,109,380 | 8/1978 | Anderson | 30/335 |

FOREIGN PATENT DOCUMENTS

| | | | |
|---|---|---|---|
| 310196 | 4/1929 | United Kingdom | 30/330 |
| 992612 | 5/1965 | United Kingdom | 30/331 |

*Primary Examiner*—Douglas D. Watts
*Assistant Examiner*—Paul M. Heyrana, Sr.
*Attorney, Agent, or Firm*—Gottlieb, Rackman & Reisman

[57] ABSTRACT

This invention relates to utility knives used to cut various items, including cartons, cardboard, string and wallpaper. Specifically, the invention provides a disposable one-piece razor blade utility knife in which the blade is adjustable yet permanently affixed to the knife handle. When the complementary shells of the handle are open, the blade may be placed in a usable position in which the cutting edge will protrude out of the handle when the shells of the knife are later closed or in a safety position in which the blade will be fully retained in the handle when the knife is closed.

53 Claims, 5 Drawing Sheets

FIG. 2
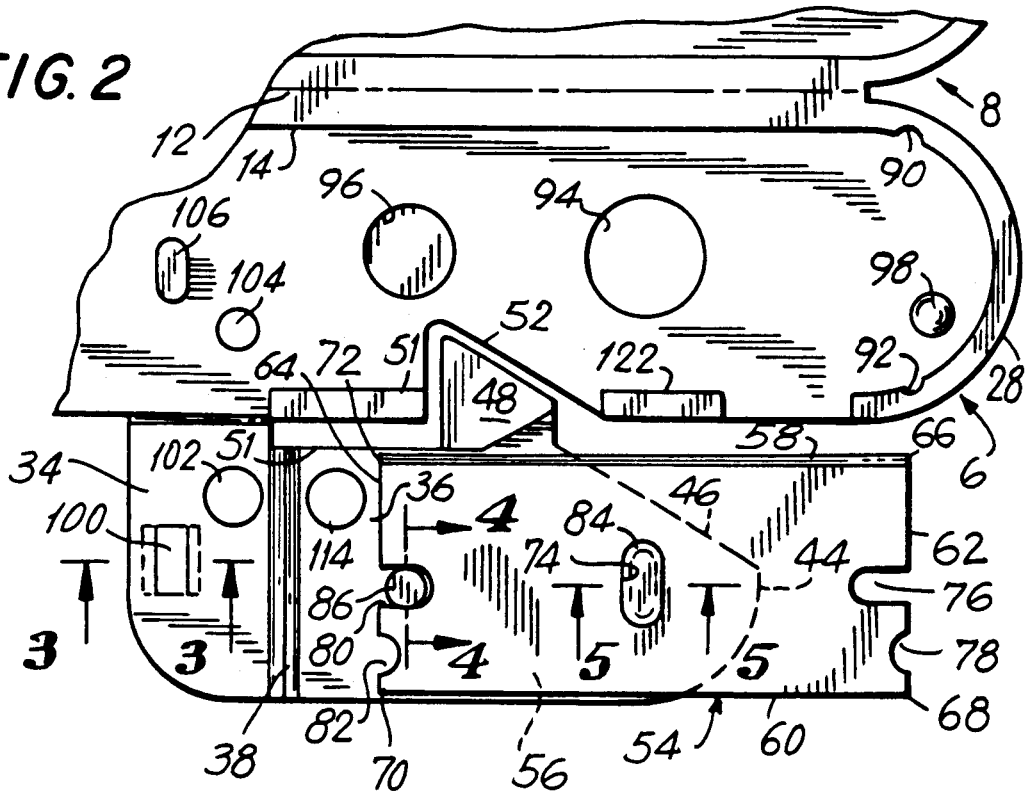
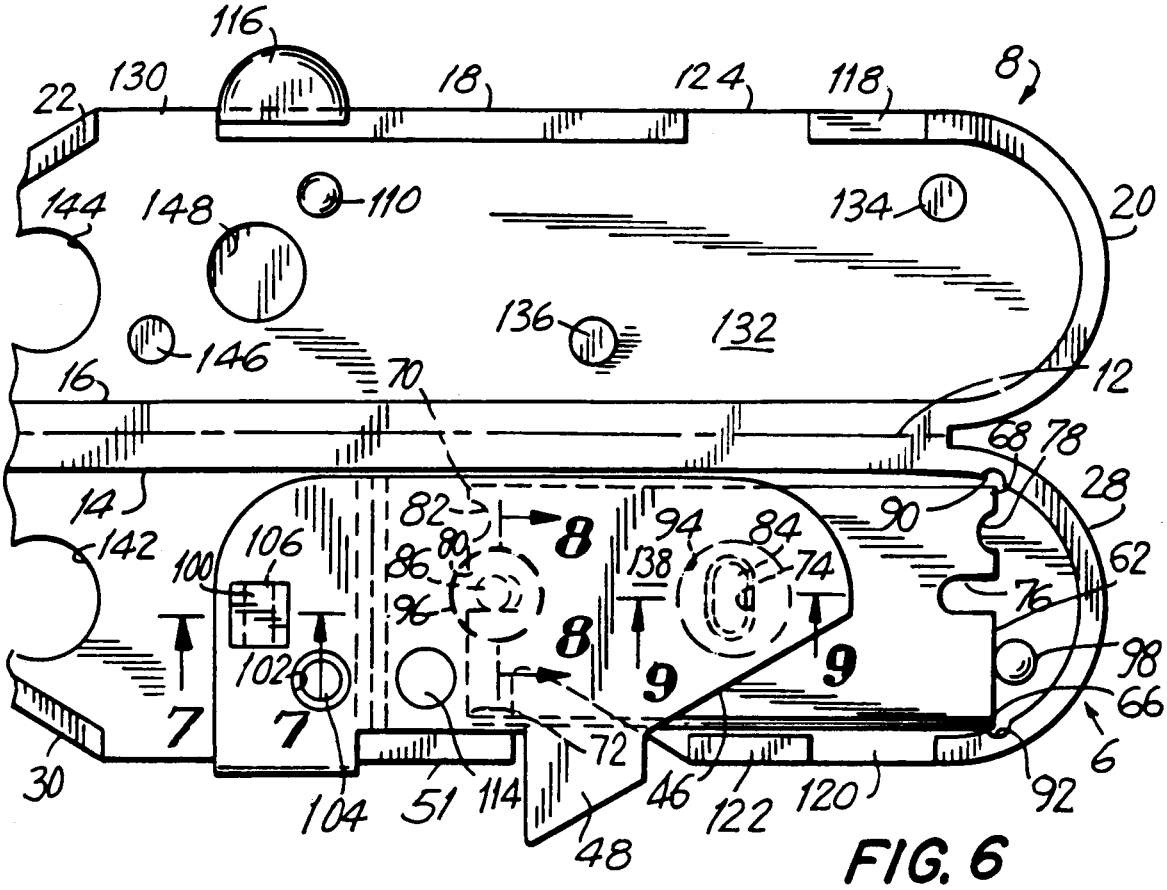
FIG. 6

FIG. 3
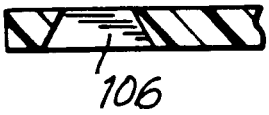
FIG. 4
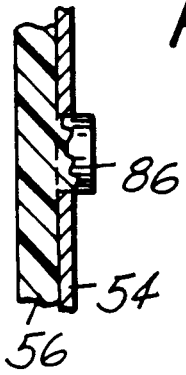
FIG. 5
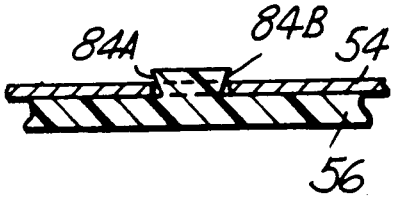
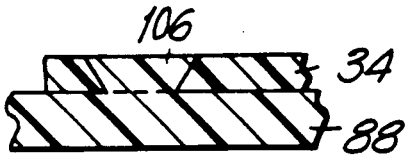
FIG. 7
FIG. 8
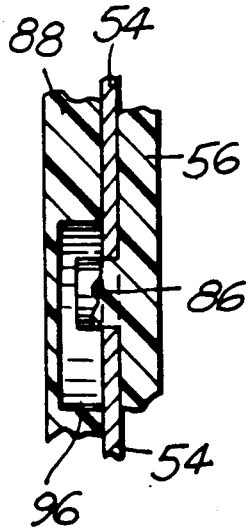
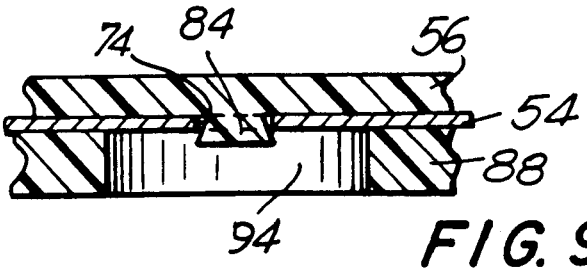
FIG. 9

FIG. 10
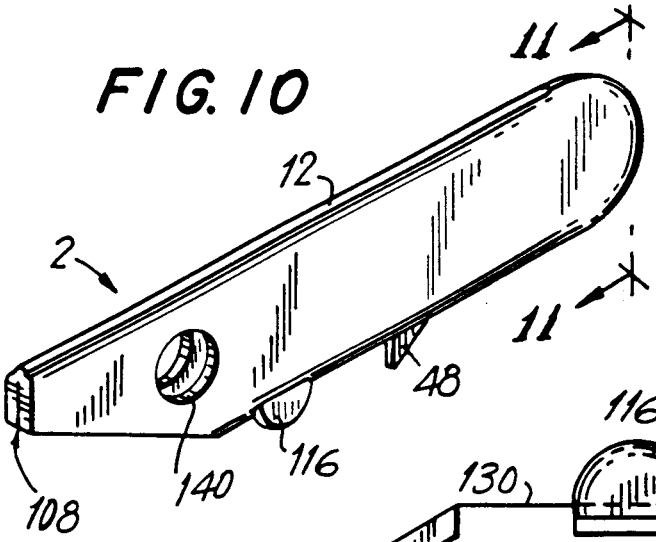
FIG. 12
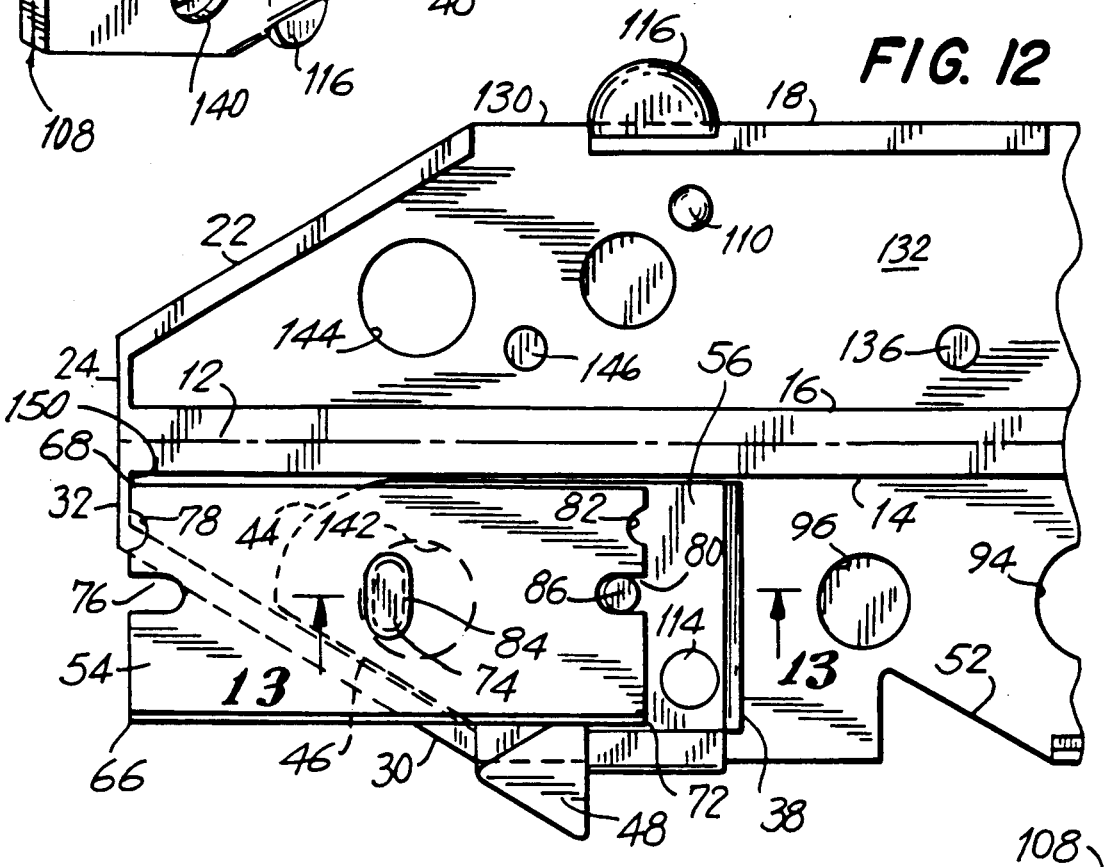
FIG. 14
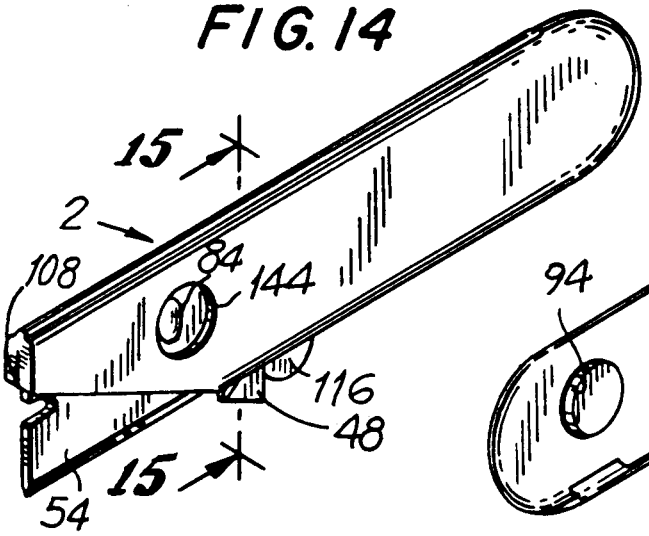
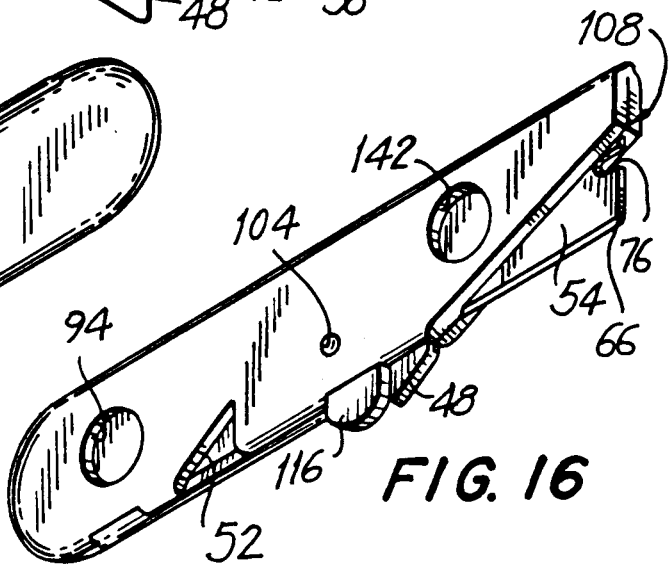
FIG. 16

UTILITY KNIFE

BACKGROUND AND PRIOR ART

1. Field of the Invention

This invention relates to utility knives used to cut various items, including cartons, cardboard, string and wallpaper. Specifically, my invention provides a disposable one-piece razor blade utility knife in which the blade is adjustable yet permanently affixed to the knife handle. When the complementary shells of the handle are open, the blade may be placed in a usable position in which the cutting edge will protrude out of the handle when the shells of the knife are later closed or the blade may be placed in a safety position in which the blade will be fully retained in the handle when the knife is closed.

2. Description of the Prior Art

Utility knives with adjustable blades are well-known in the art. These utility knives are generally of two types, which share the characteristic of replaceable blades but differ in operation. These utility knives generally are constructed as a pair of complementary shells secured together, forming an enclosure for the knife blade and a frontal opening for the cutting edge of the blade to protrude therethrough.

In one knife structure, the blade is detachably affixed to a separate mounting structure disposed longitudinally within the handle enclosure and extending through the top of the enclosure. Pressure on the exterior mounting moves the blade from its enclosure within the handle to the cutting position. The two shell portions of the handle are generally made of metal and are secured together by screws. Therefore, in order to replace the blade the shells must be unscrewed with a screwdriver.

In another knife structure, the blade is also detachably affixed to a separate mounting structure disposed within the handle so that the blade may be replaced after it has worn out. The mounting structure is attached to one of the shells near the hinge. However, the blade is not moved from one position to another by pressure on an exterior mounting but by the operator when the knife is in an open position. The two shells of the handle are made of plastic and are permanently affixed together along one of the longitudinal sides of each shell and are detachably affixed at the opposite sides, permitting the knife to be open and closed without use of a screwdriver. This arrangement is typified by U.S. Pat. No. 3,520,059 issued to Donald Gringer on July 14, 1970.

Both of the utility knives described above are constructed specifically to permit the user to replace worn-out blades. The blades are not permanently affixed to the handle and thus can easily be loosened when the knives are in use, which can result in a delay in performing the cutting task while the blade is re-secured to the mount.

SUMMARY OF THE INVENTION

My invention solves the problem presented by prior art utility knives having replaceable blades. Specifically, my invention provides a disposable one-piece razor blade utility knife in which the blade is adjustable yet is permanently affixed to the handle.

The plastic handle of my utility knife is formed in one piece by injection molding. The handle initially comprises two complementary shells permanently affixed to one another by a hinge along congruent side edges. A portion of the opposite edge of one of the shells is affixed by a living hinge to an edge of a separate flap member designed to permanently secure the blade thereto. The flap is then folded along the hinge and permanently secured to the shell. The flap itself is split by a hinge which permits the blade either to extend through a frontal opening created when the shells are closed or to remain fully enclosed within the handle when the shells are closed. Since the blade is permanently affixed to the flap, when the knife is in use there is no danger of the blade becoming loose and the knife unusable, which can occur in the prior art utility knives.

This knife handle structure is relatively inexpensive to manufacture. Further, the knife itself is compact and is easily carried in a clothing pocket since it is very lightweight and presents a slim appearance when closed.

It is, therefore, an object of this invention to provide a disposable one-piece utility knife having an adjustable blade permanently affixed to the handle.

It is another object of this invention to provide a knife handle structure which is inexpensive to manufacture. It is an additional object of this invention to provide a utility knife which is compact and lightweight.

It is a further object of this invention to provide a method of producing a one-piece handle for a utility knife.

BRIEF DESCRIPTION OF THE DRAWINGS

FIG. 2 is a plan view showing the second flap member having the blade affixed thereto and being attached to the first flap member affixed to the first shell;

FIG. 3 is a sectional view taken along the line 3—3 of FIG. 2;

FIG. 4 is a sectional view taken along the line 4—4 of FIG. 2;

FIG. 5 is a sectional view taken along the line 5—5 of FIG. 2;

FIG. 6 is a plan view showing the second flap member having the blade affixed thereto and being attached to the first flap member, with the entire flap member secured within the first shell;

FIG. 7 is a sectional view taken along the line 7—7 of FIG. 6;

FIG. 8 is a sectional view taken along the line 8—8 of FIG. 6;

FIG. 9 is a sectional view taken along the line 9—9 of FIG. 6;

FIG. 10 is a perspective view of the utility knife of the present invention in a closed position in which the blade is enclosed within the handle;

FIG. 12 is a plan view showing the second flap member having the blade affixed thereto and resting on top of the first flap member within the first shell such that the blade protrudes over the first shell;

FIG. 14 is a perspective view of the utility knife of the present invention in a closed position in which the blade protrudes through a frontal opening;

DETAILED DESCRIPTION OF THE DRAWINGS

Figure 1:
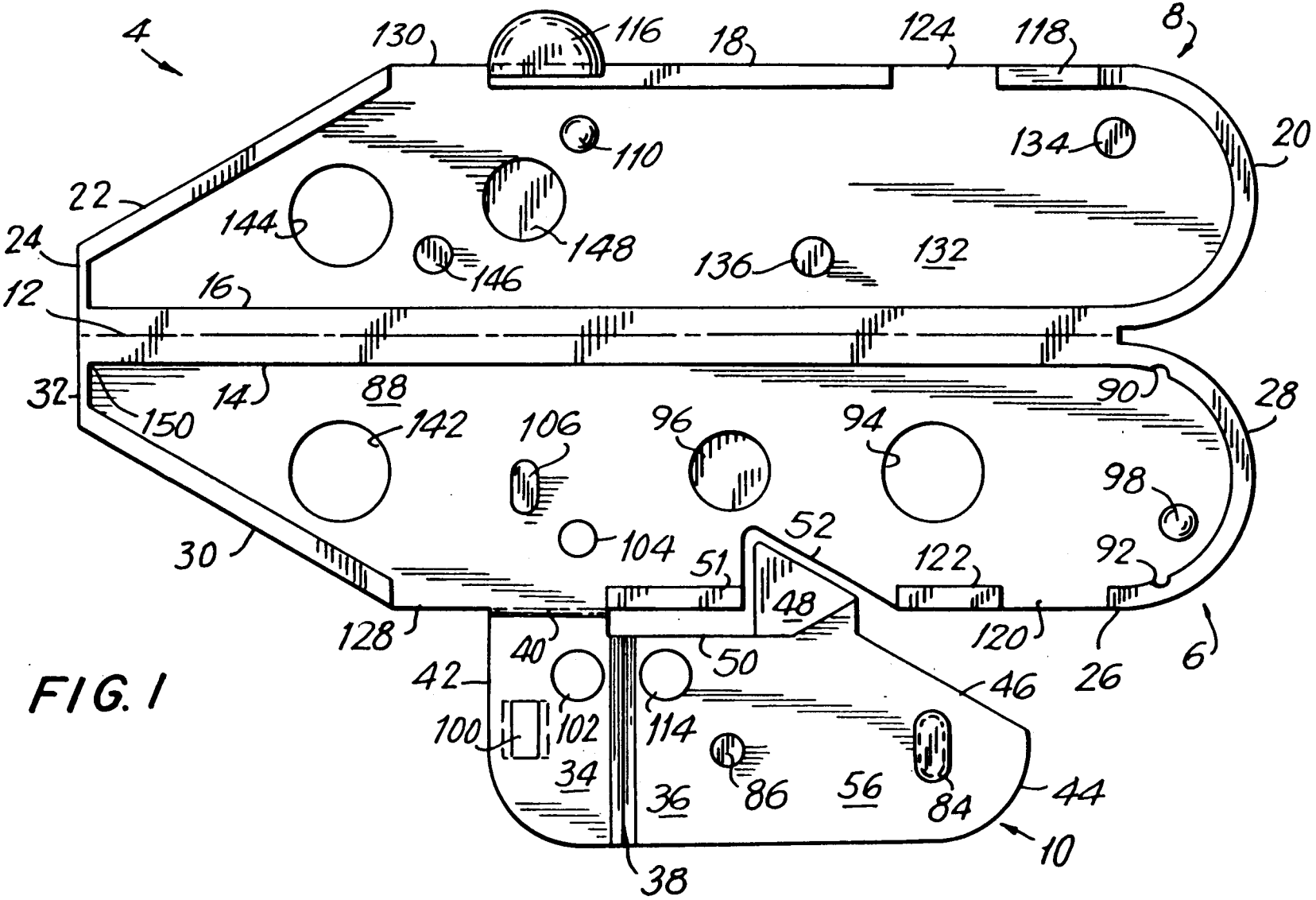
FIG. 1 is a plan view of the knife handle of the present invention.

FIG. 1 is a plan view of a knife handle 4, which is preferably made of resilient plastic. Handle 4 is constructed to include of a pair of complementary shells 6 and 8 and a flap member 10 for receiving a blade (shown in FIG. 2). A one-piece living hinge 12 is secured to an inner side edge 14 of a first shell 6 and to an inner side edge 16 of a second shell 8 such that hinge 12 is integral with shells 6 and 8 and extends longitudinally with shells 6 and 8.

Second shell 8 has an outer raised edge 18 opposite and parallel to an inner raised edge 16, a rounded raised end edge 20, an opposite raised angled end edge 22 and a raised vertical edge 24 forming an obtuse angle with an angled raised end edge 22. First shell 6 complements second shell 8, with an outer raised edge 26 opposite and parallel to an inner raised edge 14, a rounded raised end edge 28, an opposite angled raised end edge 30, and a vertical raised edge 32 forming an obtuse angle with an angled end edge 30. When knife handle 4 is closed, the complementary edges of shells 6 and 8 generally meet (inner raised edges 14 and 16, rounded raised end edges 20 and 28, outer raised edges 18 and 26, angled raised end edges 22 and 30, vertical edges 24 and 32) and generally present a flush outer edge.

Flap member 10 is bisected by a living hinge 38, creating a first flap member 34 and a second flap member 36. First flap member 34 is permanently affixed to first shell 6 by a living hinge 40 along shell outer edge 26. The edge structure of first flap member 34 includes a rounded side edge 42 which extends past hinge 38 to a rounded side edge 44 of second flap member 36, which in turn extends into an angled side edge 46. A raised angled tab 48 lies between an angled side edge 46 and a straight edge 50, and extends into an indentation 52 in side edge 26 of first shell 6.

FIG. 2 shows the placement of a blade 54 on second flap member 36. Blade 54 is a conventional single edge razor blade modified so that the protective strip (?) is removed along the non-sharp edge. Blade 54 is designed to be permanently affixed upon an inner face 56 of second flap member 36. Blade 54 has two longer parallel opposing side edges 58 and 60 and two shorter parallel opposing side edges 62 and 64 joined therebetween at four corners: 66, 68, 70 and 72. A side edge 58 is shaved to form a sharp cutting edge. In the center of blade 54 is a substantially rectangular aperture 74 whose longer sides are parallel to sides 62 and 64 and perpendicular to sides 58 and 60. Side edge 62 contains an elongated semicircular indentation 76 substantially in the center thereof and a smaller semicircular indentation 78 between indentation 76 and corner 68. Opposing indentations are similarly spaced on side 64, namely a center elongated semicircular indentation 80 and a smaller semicircular indentation 82 located between indentation 80 and corner 70.

Second flap member 36 is constructed with a tab 84 pro-truding out of inner face 56 (see FIG. 1), designed to fit into blade center aperture 74, and a protruding pin 86 (see FIG. 1) designed to abut blade semicircular indentation 80. FIG. 4 is a cross-sectional view of pin 86 and its association with blade 54, which rests upon inner face 56. In FIG. 5, the cross-section of tab 84 and blade 54 is seen. The side edges **84*a* and 84*b* of tab 84 are straight and are slightly angled inward, so that tab 84 tightly fits within blade center aperture 74. Tab 84 "melts", providing a secure fixation, when blade 54 is permanently affixed to second flap member 36 by sonic welding. Blade 54 covers most of second flap inner face 56, shown in FIG. 2 in dotted lines, such that side 58 abuts angled tab 48, and side 60 is substantially even with the straight portion of rounded edge 44. Blade 54 extends over rounded side edge 44 and angled edge 46** such that a cutting edge is revealed.

The reason for the specific construction of first flap member 34 and second flap member 36 becomes apparent, as seen in FIG. 6, when flap member 10 is rotated about hinge 40 so that flap member 10 and blade 54 lay flush against an inner face 88 of first shell 6, in a first position. With reference to second flap member 36, rounded side 44 of second flap member 36 evenly abuts first shell inner side edge 14 and blade 54 extends outwardly from second flap member 36 such that side edge 60 abuts first shell inner side edge 14. Blade corners 68 and 66 extend, respectively, into semicircular indentations 90 and 92 in rounded end 28, which act to locate and/or retain blade 54 in said first shell 6. Angled tab 48 extends over indentation 52 and blade 54 is also visible through angled indentation 52. Side 50 of flap member 36 evenly abuts raised tab 51 of first shell outer side edge 26.

Tab 84 does not rub against inner face 88 but extends through a circular aperture 94, seen in FIG. 1 and in outline in FIG. 6. FIG. 9 is a cross-sectional view, revealing tab 84 protruding from inner flap face 56 through blade center aperture 74 and further extending through aperture 94 of first shell 6. Similarly, pin 86 abuts a circular indentation 96, also seen in FIG. 1, in outline in FIG. 6, and in cross section in FIG. 8. Pin 86 protrudes from inner face 56 of flap member 36 and through blade indentation 80 to abut circular aperture 96 of first shell inner face 88. The combination of tab 84 and circular aperture 94 and pin 86 and circular indentation 96 serves to maintain blade 54 evenly against inner face 88 of first shell 6, as shown in FIG. 6, since blade 54 is able to rest directly against inner surface 88. Further, blade edge 62 abuts a circular tab 98 protruding from inner face 88 slightly above and to the right of circular indentation 92 near rounded end 28. Circular tab 98 serves to prevent lateral movement of blade 54 when knife 2 is in an open position, as depicted in FIG. 6, or in a closed position as depicted in FIG. 10, and when the blade is in its non-operative or stored position.

First flap member 34 is permanently affixed to inner face 88 of first shell 6. As seen in FIGS. 1 and 2, first flap member 34 has a rectangular aperture 100 located near and substantially in the middle of side 42 and a circular aperture 102 located in the corner between hinge 38 and hinge 40. First shell 6 has a slightly smaller circular aperture 104 corresponding to flap circular aperture 102 and a rectangular sealing tab 106 corresponding to rectangular aperture 100, seen in cross section in FIG. 3. Tab 106 has slightly rounded end edges which fit firmly into flap aperture 100. As depicted in FIG. 6, when first flap member 34 is rotated about hinge 40 so that flap member 10 lies against inner face 88 of first shell 6 (the first position), sealing tab 106 firmly joins with aperture 100 and flap circular aperture 102 lies directly over shell circular aperture 100, creating an even surface between first shell 6 and first flap member 34. Flap member 34 is permanently affixed to first shell 6 by melting the plastic of sealing tab 106 to rectangular aperture 100, such as by sonic-welding. As seen in cross-section in FIG. 7, tab 106 is firmly embedded in flap member 34 and rests upon inner face 88 of first shell 6.

In FIG. 10, flap member 10 has been placed in the first position resting against first shell 6, and knife 2 has been folded at hinge 12 and placed in the closed position. When knife 2 is closed, the circumferential edges of shells 6 and 8 lay flush against one another—raised side edge 26 of first shell 6 meets raised side edge 18 of second shell 8, raised rounded end 28 of first shell 6 meets raised rounded end 20 of second shell 8, and raised tapered edge 32 of first shell 6 meets raised tapered edge 24 of second shell 8, presenting a combined frontal opening 108.

Figure 11:
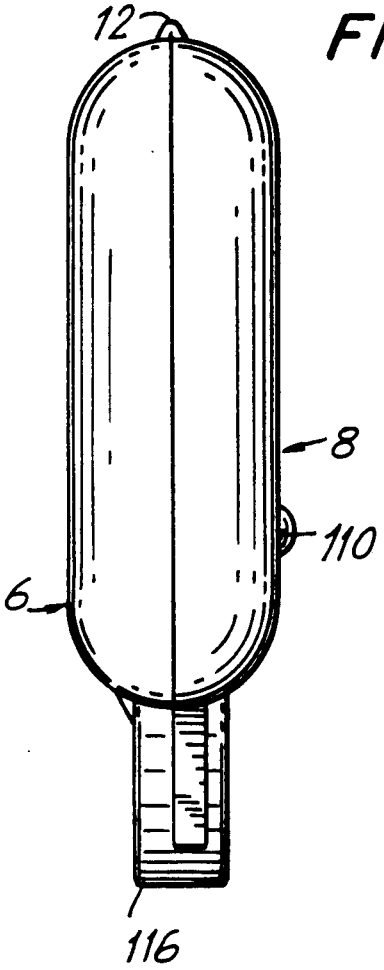
FIG. 11 is a rear view taken along the line 11—11 of FIG. 10.

The circumferential edges of knife handle 4 are detachably affixed together by a variety of means. When second shell 8 is rotated about hinge 12 to meet first shell 6 and enclosed flap member 10, seen in FIG. 1 and FIG. 6, a locking pin 110 engages combined apertures 102 and 104 of flap member 10 and first shell 6, respectively. Pin 110 is tightly held by aperture 104, which is slightly smaller than aperture 102, and pin 110 protrudes slightly therethrough aperture 104 to extend over an outer face 112 of first shell 6. FIG. 11 is a rear view taken along lines 11—11 of FIG. 10, showing angled tab 48 overlaying a rounded tab 116 and pin 110 protruding through apertures 102 and 104 to extend slightly over outer face 112.

As seen in FIG. 1, there is a rounded connecting tab 116 above pin 110 extending from and above side edge 18 of second shell 8. Tab 116 is of sufficient width to detachably connect hinge 40 (linking first flap member 10 and first shell 6) when knife 2 is in the closed position depicted in FIG. 10.

With reference to FIG. 1, other detachable means include a tab 118, which protrudes and extends from side edge 18 of second shell 8 near rounded end 20 to join with an opposing indentation 120 located in side edge 26 of first shell 6 near rounded end 28. This mechanism is repeated with a tab 122, protruding and extending from side edge 26 of first shell 6 near angled indentation 52, which tab joins with an opposing indentation 124, located in side edge 18 of second shell 8. The corresponding indentations and tabs join with one another whether second flap member 36 is in the first position overlaying first shell 6 or is in the second position overlaying first flap member 34.

When second flap member 36 is in the first position and knife 2 is closed (FIG. 10), angled tab 48 extends over indentation 52, seen in FIG. 1. When second flap member 36 is in the second position and knife 2 is closed (FIG. 15), angled tab 48 protrudes through an indentation 126 (not shown?) created by the combination of an indentation 128 located between angled end edge 30 and hinge 40 of first shell 6 and an indentation 130 located in between angled end edge 22 and tab 116 of first shell 8 (see FIG. 1).

Knife 2 may be opened from the closed position by finger pressure by the operator on rounded tab 116 and angled tab 48, whether second flap member 36 is in the first or second position. For example, if the operator pulls rounded tab 116 with his/her right thumb and angled tab 48 with his/her left thumb, knife 2 will open. Knife 2 will also open when second flap member 36 is in the second position if the left thumb is placed in indentation 52 and the right thumb pulls rounded tab 116. When knife 2 is already open, flap member 36 is moved between the first position overlaying first shell 6 and the second position overlaying first flap member 34 by placing angled tab 48 between the thumb and forefinger and rotating angled tab 48.

A unique feature of my invention is that in addition to providing one of the means to open and close knife handle 4, angled tab 48 acts to move second flap member 36 and thus adjusts blade 56 between the first position and the second position.

When knife 2 is closed, the combination of the detachable tabs and indentations serves to retain second flap member 36 and blade 54 in the first or second position. My invention is also provided with additional retaining means located on an inner face 132 of second shell 8, as depicted in FIG. 1. When second flap member 36 is in the first position overlaying inner face 88 of first shell 6 (see FIG. 6) and knife handle 4 is closed (see FIG. 10), a retaining pin 134, located below and slightly to the right of tab 118 (see FIG. 1), protrudes from inner face 132 and presses against blade 54, retaining it in place against first shell inner surface 88. A retaining pin 136, located slightly above hinge 12 between locking pin 110 and retaining pin 134, protrudes from inner face 132 and presses against outer face 138 of second flap member 36, thus retaining it in place. Thus, pins 134 and 136 function to bear against blade 54 and second flap member 36, respectively, to keep the flap and blade in place and against shell 6 when the knife is closed and the blade is in its inoperative, closed position.

When in this closed position, as depicted in FIG. 10, knife 2 can be placed on a hook inserted through hangar aperture 140, created by a circular aperture 142 of first shell 6 and a circular aperture 144 of second shell 8, as seen in FIG. 1.

Second flap member 36 is specifically designed to permit blade 54 to be in the first "safety" position, lying against inner face 88 of first shell 6, and in a second "use" position, lying against first flap member 34, as depicted in FIG. 12.

Figure 13:
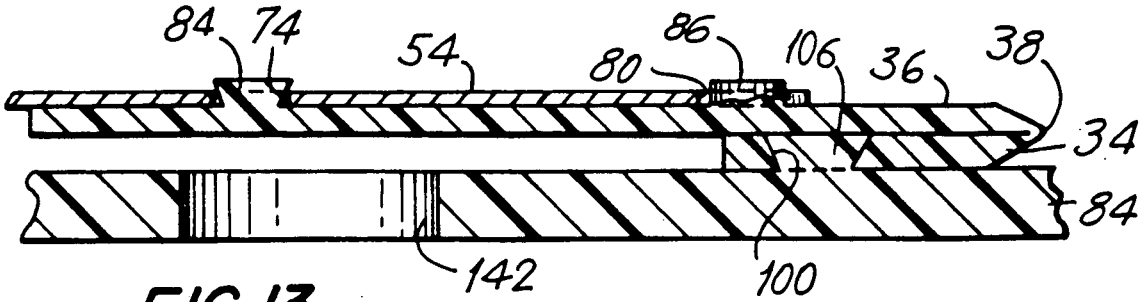
FIG. 13 is a sectional view taken along the line 13—13 of FIG. 12.

FIG. 13 is a cross-sectional view taken along lines 13—13 of FIG. 12, depicting blade 54 resting upon inner surface 56 of second flap member 36. Rectangular tab 84 protrudes through blade aperture 74, and protruding pin 86 protrudes through blade indentation 80. When second flap member 36 is in the second position overlaying first flap member 34, a space is created between second flap member 36 and first shell inner surface 88, as depicted in FIG. 13.

When flap member 36 is in the second position, aperture 114 is aligned with aperture 102, and angled tab 48 extends over indentation 128 (see FIG. 1). Flap side edge 46, covered by blade 56 and depicted as a dotted line in FIG. 12, neatly abuts raised tapered end edge 30. Flap side edge 44 abuts first shell inner side edge 14. Blade corner 68 (see FIGS. 2 and 12) abuts a corner 150 of first shell 6, and knife 2 is in the closed position (see FIG. 14 and 16) 54 protrudes through frontal opening 108 to perform its cutting task.

FIG. 16 also depicts the dual purpose of circular hangar aperture 142. When flap member 36 is in the second "cutting" position and knife 2 is closed, blade tab 84 protrudes through aperture 142 rather than abutting inner surface 132 of shell 8.

Figure 15:
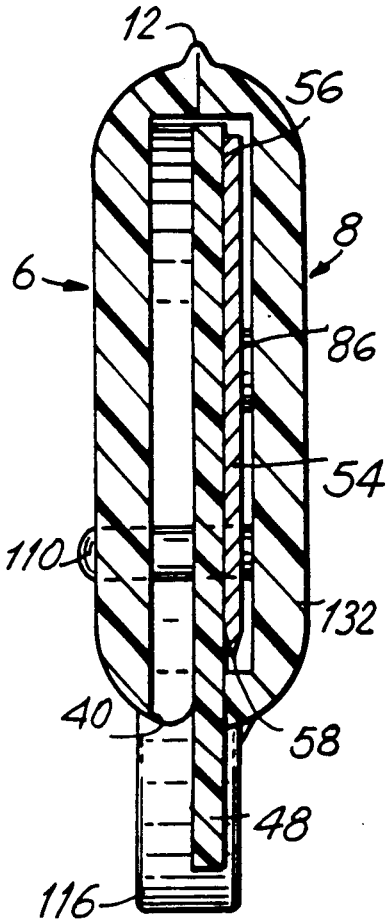
FIG. 15 is a sectional view taken along the line 15—15 of FIG. 14.

FIG. 15 is a cross-sectional view of lines 15—15 of FIG. 14. Locking pin 110 protrudes from inner surface 132 of second shell 8 through combined apertures 114 (second flap member 36), aperture 102 (first flap member 34) and aperture 104 (first shell 6) and extends over outer face 112 of first shell 6.

Second shell 8 is also provided with means to retain second flap member 36 when it is in the second position overlaying first flap member 34, as depicted in FIG. 12. Retaining pin 146, located slightly above hinge 12 and to the right of aperture 144, protrudes from inner surface 132 of second shell 8 and when knife handle 4 is closed, pin 146 presses against blade 54 and retains it in position. Circular indentation 148, to the right of pin 146, acts to prevent blade pin 86 from grounding out on inner surface 132 of shell 8, in the same fashion as indentation 96 acts in relation to blade pin 86 when second flap member 36 is in the first position (see FIG. 6).

Although shown and described in what are believed to be the most practical and preferred embodiments, it is apparent that departures from the specific methods described and shown will suggest themselves to those skilled in the art and may be made without departing from the spirit and scope of the invention. I, therefore, do not wish to restrict myself to the particular methods described and illustrated, but desire to avail myself of all modifications that may fall within the scope of the appended claims.

In summary, my invention provides a utility knife which is disposable, compact and lightweight. The knife handle of my invention is easy and inexpensive too manufacture. Although the preferred procedure is to use injection molding to form the plastic, such as a thermoplastic resin including polypropylene and polyethylene, other materials with similar resilient and durable characteristics may be used.

The knife blade is permanently attached to the handle yet is adjustable, moving from a first inoperable position in which it is safely enclosed within the handle to a second position in which the cutting edge protrudes from the handle. Since the blade is permanently attached to the handle, there is little chance that the blade will detach from the handle during use as a cutting tool, unlike the prior art utility knives which have replaceable blades removably secured to the knife handle.

The specific structure of the knife handle is designed so that the handle opens and closes easily, with enough space inside the handle for enclosure of the blade. The handle has two complementary shells joined by a living hinge at their inner edges. The first shell is connected at a part of its outer edge by a living hinge to a flap member which is designed to receive the knife blade. The flap member itself is bisected by a living hinge, forming a first flap member and a second flap member. The first flap member is rotated about the living hinge with the first shell and then is permanently attached to the inner surface of the first shell.

The outer edges of the complementary shells and the flap member are equipped with means to attach and detach the outer edges to one another, including a tab on the outer edge of the second shell which is wide enough to grip the opposite edge of the first shell where the first flap member is attached by the hinge. Although the tab of my invention is preferably rounded, any shape which can be easily gripped is appropriate. The second flap member has an angled tab protruding therefrom which has a dual function—(1) to adjust the flap and blade from the first inoperative position enclosed within the first shell to the second operative position in which the blade extends over the first shell so that the cutting edge is exposed and (?) to aid in opening and closing the complementary shells. If the operator's right thumb is placed on the rounded tab and the left thumb on the angled tab, pressure on both tabs will open the handle. The left thumb may also be placed in the angled indentation in the first shell, revealed when the second flap member is in the second operative position. Although the operating flap tab is preferably angled, any shape which can be easily gripped is acceptable.

Other detachable means include corresponding indentations and tabs in the outer edges of each shell. The handle is also equipped with means to retain the flap member and blade in the first inoperative position or the second operative position when the knife is closed.

The closed knife presents a slim line, with a rounded end and an angled opposing end with a frontal opening which the blade protrudes through. Of course, numerous shapes are possible for each end, as long as the knife has enough space to be enclosed within the complementary shells and a cutting edge can extend through a frontal opening.

I claim:

1. A knife comprising (a) a resilient handle, (b) a blade fixedly connected to said handle, said handle including (1) a pair of complementary shells, each shell presenting an inner face and an outer face, (2) a hinge integral with both of said shells, secured to an inner side of each of said first and second shells and extending longitudinally with said shells, (3) a flap having a first flap member fixedly secured to said inner face of said first shell and a second flap member for receiving said blade, (4) a second hinge connecting said first flap member to said second flap member such that when said knife is in an open position said second flap member can rotate about said second hinge from a first position overlaying said inner face of said first shell to a second position overlaying said first flap member, and (5) means for detachably securing each of said shells to one another thereby forming an enclosure for said second flap member and blade when said knife is in a closed position.

2. The knife of claim 1, wherein each of said shells is elongated.

3. The knife of claim 1, wherein when said knife is in the closed position, said handle has a closed first end and an opening at said opposite second end for said blade to protrude through.

4. The knife of claim 3, wherein said closed first end and said second open end are formed when congruent outer edges of said shells meet.

5. The knife of claim 4, wherein said congruent outer edges of said shells are rounded at said closed first end and are tapered at said second open end.

6. The knife of claim 3, wherein when said second flap member is in the second position and said knife is in the closed position, said blade extends through said opening and outside said second open end.

7. The knife of claim 3, wherein when said second flap member is in the first position and said knife is in the closed position, said blade is fully enclosed within said closed first end.

8. The knife of claim 3, wherein each of said shells has an aperture therethrough near said second open end such that when said second flap member is in the first position and said knife is in the closed position, said apertures are aligned and form a hanger for said knife.

9. The knife of claim 8, wherein when said second flap member is in the second position and said knife is in the closed position, said apertures are covered by said blade and said second flap member and said hanger is inoperative.

10. The knife of claim 3, wherein a sealing tab protrudes through said inner face of said first shell and firmly fits through an aperture therethrough said first flap member, said sealing tab being sealed within said aperture to fixedly secure said first flap member to said inner face of said first shell.

11. The knife of claim 10, wherein said blade is rectangular, having two longer parallel opposing sides and two shorter parallel opposing sides joined therebetween at four corners, with a longitudinally shaped aperture substantially in the center thereof, two first semicircular indentations located in the center of each said shorter side edges, and two second smaller semicircular indentations located in each said side edge between said first indentations and said corner edges.

12. The knife of claim 11, wherein said blade is a single-edge razor blade without a guard.

13. The knife of claim 12, wherein said second flap member has one substantially straight side edge adjacent said first shell hinge extending to a rounded top edge and an angled side edge such that said flap member folds into said first shell in the first or second flap position when said knife is in the open or closed position.

14. The knife of claim 13, wherein said second flap member has a first face for receiving said blade and a second face, said first face having a rectangular tab protruding therefrom near said rounded top edge corresponding to fit into said center aperture of said blade and a pin protruding therefrom near said second hinge corresponding to fit into said center side indentation of said blade, said blade tab and blade pin being sealed within said aperture to fixedly secure said blade to said inner face of said second flap member.

15. The knife of claim 1, wherein said detachable means comprises a first tab extending from said second flap member such that said tab protrudes when said flap member is folded into said enclosure in the first or second flap position when said knife is in the closed position.

16. The knife of claim 15, wherein said detachable means comprises a first indentation in said outer side edge of said first shell, said indentation corresponding to said first tab when said second flap member is in the first position.

17. The knife of claim 10, wherein said detachable means comprises a second set of opposing indentations in each said outer side edge of each said shell, such indentations forming an opening for said first tab to extend therethrough when said knife is in the closed position and said second flap member is in the second position.

18. The knife of claim 17, wherein said detachable means comprises said first flap member having an aperture therethrough corresponding to an aperture therethrough said first shell.

19. The knife of claim 18, wherein said detachable means comprises said second flap member having an aperture therethrough corresponding to said apertures of said first flap member and said first shell when said second flap member is in the second position.

20. The knife of claim 19, wherein said detachable means comprises a locking pin extending outwardly from said inner face of said second shell engaging said apertures of said first flap member and said first shell when said knife is in the closed position and when said second flap member is in the first position and engaging said apertures of said second flap member, said first flap member, and said first shell when said knife is in the closed position and when said second flap member is in the second position.

21. The knife of claim 20, wherein said detachable means comprises a second tab extending from and above said outer side edge of said second shell above said locking pin, said tab being of sufficient width to firmly join with said opposite outer side edge of said first shell when said knife is in the closed position.

22. The knife of claim 21, wherein said detachable means comprises a third set of tabs extending from each of said outer side edges of said first and second shells near said first ends, each said tab corresponding to one of a third set of indentations in said outer side edges of each said opposite shells.

23. The knife of claim 22, wherein when said second flap member is in the second position and said knife is in the closed position, said locking pin firmly extends through said apertures of said second flap member, said first flap member, and said first shell, said first tab protrudes from said second flap member over said rectangular opening, said second tab firmly joins said opposite outer side edge, and said third set of tabs corresponds to said third set of indentations, whereby pressure placed on said first tab and said second tab or said first indentation moves said knife from the closed position to the open position.

24. The knife of claim 23, wherein when said second flap member is in the first position and said knife is in the closed position, said locking pin firmly extends through said apertures of said first flap member and said first shell, said first tab protrudes from said second flap member over said first indentation, said second tab firmly joins said opposite outer side edge, and said third set of tabs corresponds to said third set of indentations, whereby pressure placed on said second tab and said first tab moves said knife from the closed position to the open position.

25. The knife of claim 15, wherein said first tab is angled.

26. The knife of claim 16, wherein said first indentation is angled.

27. The knife of claim 17, wherein said second set of opposing indentations are rectangular.

28. The knife of claim 21, wherein said second tab is rounded.

29. The knife of claim 22, wherein said third set of tabs and said third set of indentations are rectangular.

30. The knife of claim 1, wherein said shells have means for retaining said flap member and blade.

31. The knife of claim 30, wherein said retaining means comprises a first retaining tab protruding from said inner face of said second shell, such that when said knife is in the closed position and said second flap member is in the first position said first tab presses against said blade and retains said blade in the first position.

32. The knife of claim 31, wherein said retaining means comprises a second retaining tab protruding from said inner face of said second shell such that when said knife is in the closed position and said second flap member is in the first position said second tab presses against said outer face of said second flap member and retains said second flap member in the first position.

33. The knife of claim 32, wherein said retaining means comprises a third retaining tab protruding from said inner face of said second shell, such that when said knife is in the closed position and said second flap member is in the second position said third tab presses against said blade and retains said blade in the second position.

34. The knife of claim 33, wherein said retaining means comprises a first indentation in said inner face of said second shell corresponding to said sealing tab and said aperture combination in said first flap member, such that when said knife is in the closed position and said second flap member is in the first position, said indentation provides space for said sealing tab to protrude, and when said second flap member is in the second position, said first indentation provides space for said blade pin to protrude from said inner face of said second flap member.

35. The knife of claim 34, wherein said retaining means comprises a pair of second opposing indentations in said first end edge of said first shell, such that when said knife is in the closed position and said second flap member is in the first position, two of said corner edges of said blade abut each said indentation.

36. The knife of claim 35, wherein said retaining means comprises a fourth retaining tab protruding from said inner face of said first shell, such that said shorter blade edge abuts said tab and prevents lateral movement of said blade when said second flap member is in the first position.

37. The knife of claim 36, wherein said retaining means comprises a first aperture therethrough said inner face of said first shell corresponding to said blade tab and aperture combination such that when said knife is in the open or closed position and said second flap member is in the first position said aperture provides space for said blade tab to protrude and permits visual confirmation of the existence of said blade in said knife.

38. The knife of claim 37, wherein said retaining means comprises a third indentation in said inner face of said first shell corresponding to said blade pin and aperture combination such that when said knife is in the open or closed position and said second flap member is in the first position said indentation provides space for said blade pin to protrude.

39. The knife of claim 31, wherein said first retaining tab is circular.

40. The knife of claim 32, wherein said second retaining tab is circular.

41. The knife of claim 33, wherein said third retaining tab is circular.

42. The knife of claim 34, wherein said first indentation is circular.

43. The knife of claim 35, wherein said pair of second opposing indentations is semicircular.

44. The knife of claim 36, wherein said fourth retaining tab is circular.

45. The knife of claim 37, wherein said first aperture is circular.

46. The knife of claim 38, wherein said third indentation is circular.

47. The knife of claim 1, wherein said handle is comprised of a thermoplastic resin including polypropylene and polyethylene.

48. A method of producing a knife, comprising the steps of (a) molding a knife handle, said knife handle including:
  (1) a pair of elongated complementary shells, each shell presenting an inner face and an outer face;
  (2) a hinge integral with both of said shells, secured to an inner side of each of said first and second shells and extending longitudinally with said shells;
  (3) a flap having a first flap member secured to an said first shell by a hinge integral with said first flap member and said outer shell side, and a second flap member for receiving a blade connected to said first flap member by a hinge integral with said first and second members;
  (4) means for detachably securing said shells to one another;
(b) fixedly attaching said blade onto said second flap member of said handle;
(c) rotating said first flap member about said hinge with said outer shell side such that said first flap member overlays said inner face of said first shell; and
(d) permanently affixing said first flap member to said inner face of said first shell.

49. The method of claim 48, wherein in step a said knife is injected-molded from thermoplastic resin including polypropylene and polyethylene.

50. The method of claim 48, wherein in step b said blade is said blade is sonicly attached to said first flap member.

51. The method of claim 48, wherein in step d said first flap member is melted to permanently affix it to said inner face of said first shell.

52. The method of claim 48, wherein when said knife moves from an open position to a closed position, said detachable means secure said shells to one another and thereby form an enclosure for said second flap member and blade.

53. The method of claim 48, wherein said knife moves from a closed position to an open position by pressure on said detachable means.

* * * * *